US005904641A

United States Patent [19]

Huang

[11] Patent Number: 5,904,641

[45] Date of Patent: May 18, 1999

[54] BODY EXERCISER

[76] Inventor: Ming-Hui Huang, No. 263, Tou-Yuan W. Rd., Pei-Tou Hsiang, Chang-Hua Hsien, Taiwan

[21] Appl. No.: 09/067,304

[22] Filed: Apr. 27, 1998

[51] Int. Cl.[6] ..... A63B 21/00

[52] U.S. Cl. ..... 482/131; 482/907; 482/133

[58] Field of Search ..... 482/907, 148, 482/131, 145, 133, 138

[56] References Cited

U.S. PATENT DOCUMENTS

| | | | |
|---|---|---|---|
| 4,445,684 | 5/1984 | Ruff | 482/907 X |
| 4,647,040 | 3/1987 | Ehrenfried | 482/131 |
| 4,844,453 | 7/1989 | Hestlow | 482/907 X |
| 4,877,239 | 10/1989 | Dela Rosa | 482/907 X |
| 4,892,304 | 1/1990 | DeNiro | 482/907 X |
| 5,026,049 | 6/1991 | Goodman | 482/907 X |
| 5,108,090 | 4/1992 | Reed | 482/907 X |
| 5,137,504 | 8/1992 | Mangini | 482/131 |
| 5,147,266 | 9/1992 | Ricard | 482/131 |
| 5,277,681 | 1/1994 | Holt | 482/907 X |
| 5,616,110 | 4/1997 | Nascimento | 482/131 |

OTHER PUBLICATIONS

"Flexibility By Ultra Stretch", Ultra Stretch, Portland Oregon, 1983.

"Greek's Unique Stretching Machine", Black Belt Magazine, May 1980.

"The Rack" Treco Products Inc., Poquoson Virginia, 1982.

"The Hurley Stretch Rack", Black Belt Magazine, Jul. 1986.

Martial Arts Supply Company, Inc, Los Angelas CA, Black Belt, 1979.

"Flex Master II", Century Martial Arts Supply. Inc., Oklahoma OK, 1987.

"Power Stretch 7000", Treco Products, Inc., 1987.

*Primary Examiner*—Richard J. Apley
*Assistant Examiner*—William LaManca
*Attorney, Agent, or Firm*—Ladas & Parry

[57] ABSTRACT

A body exerciser includes two leg-supporting members having first proximate ends pivoted to a seat member, and first distal ends swingable relative to the seat member on a horizontal plane. A guiding member has a second proximate end secured to the seat member between the first proximate ends, and a second distal end. A sliding member is mounted slidably on the guiding member, and is connected pivotally to the first distal ends of the leg supporting rods by two connecting members, respectively. When the user sits on the seat member and bends forward to move the sliding member toward the second distal end, the connecting members will cooperate to spread apart the leg supporting members for spreading apart the user's legs so as to exercise the user's trunk and legs.

9 Claims, 4 Drawing Sheets

BODY EXERCISER

BACKGROUND OF THE INVENTION

1. Field of the Invention

This invention relates to a body exerciser, more particularly to a body exerciser for synchronously spreading apart the legs and bending the trunk of the user.

2. Description of the Related Art

Various kinds of exercising apparatus, such as steppers and exercise bikes, are known in the art. Most of them are bulky and are operated to exercise only one body part of the user.

SUMMARY OF THE INVENTION

Therefore, the object of the present invention is to provide a body exerciser with a simple construction to be used for exercising the trunk and legs of the user synchronously.

According to this invention, a body exerciser includes two leg-supporting members having first proximate ends pivoted to a seat member and first distal ends swingable relative to the seat member on a horizontal plane. A guiding member has a second proximate end secured to the seat member between the first proximate ends, and a second distal end. A sliding member has a handle and is mounted slidably on the guiding member. Two connecting members pivot the first distal ends to the sliding member, respectively. As such, when the user sits on the seat member and bends forward to move the sliding member toward the second distal end, the connecting members will cooperate to spread apart the leg supporting members for spreading apart the user's legs.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
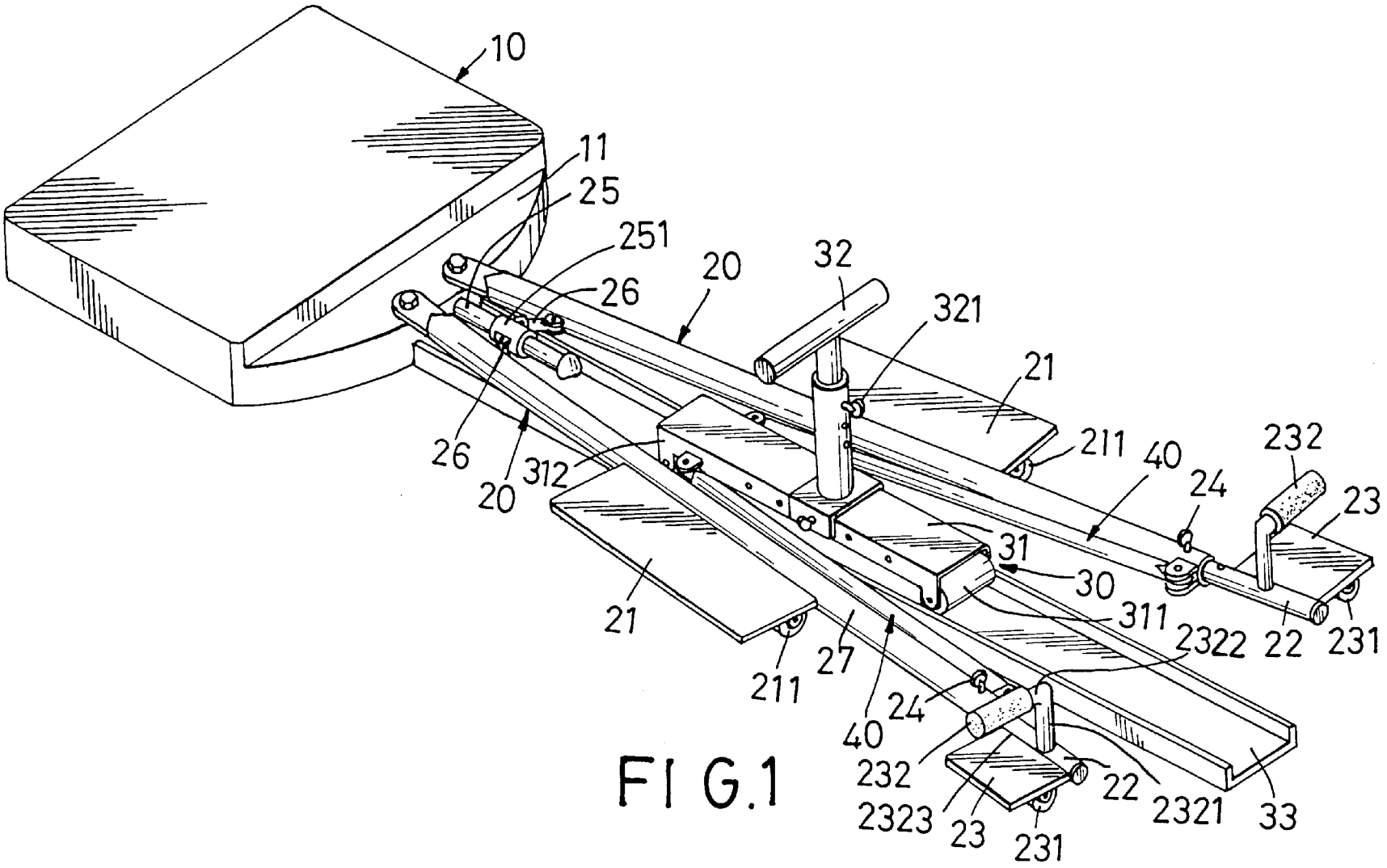
FIG. 1 is a perspective view of a first preferred embodiment of a body exerciser according to this invention.

Before the present invention is described in greater detail, it should be noted that same reference numerals have been used to denote like elements throughout the specification.

Figure 2:
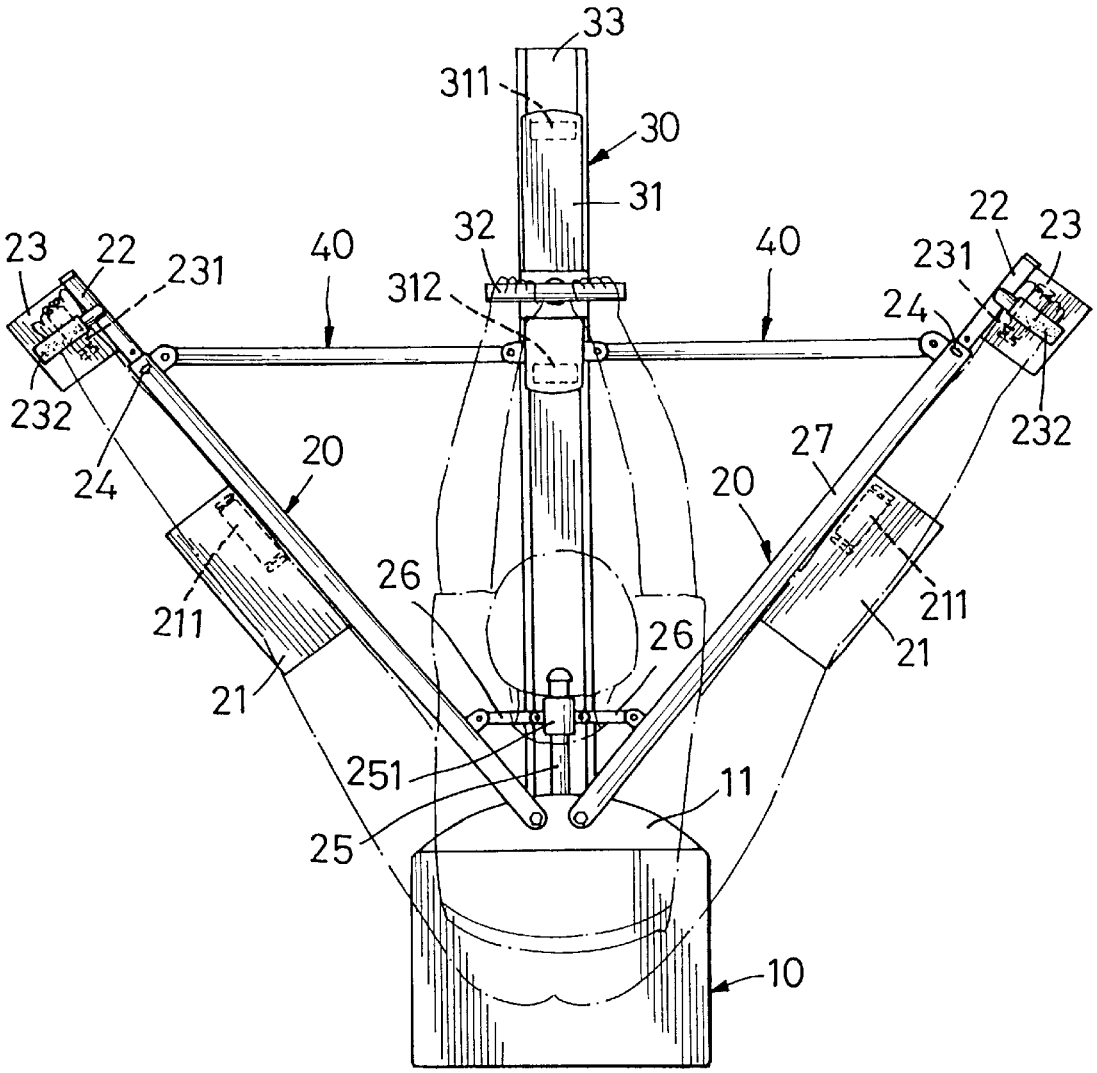
FIG. 2 is a schematic view showing one operating mode of the first preferred embodiment.

Referring to FIGS. 1 and 2, the first preferred embodiment of a body exerciser according to the present invention is shown to comprise a seat member 10, two leg supporting members 20, a sliding member 30 and two connecting rods 40.

The leg supporting members 20 include two elongated rods 27 which have first proximate ends mounted pivotally to a side 11 of the seat member 10, and first distal ends swingable relative to the seat member 10 on a horizontal plane. Two leg-supporting plates 21 are provided respectively on the rods 20 at the mid-length positions, and have wheels 211. Each of two insert rods 22 extends telescopically from the respective first distal end, and has a series of holes through which an insert pin 24 passes so as to position the insert rod 22 on the respective first distal end. Two foot-supporting plates 23 are mounted to the insert rods 22, and have wheels 231. Each of two foot-holding members 232 has a spacer segment 2321 extending transversely from a respective one of the first distal ends and normal to the foot-supporting plate 23, and an instep abutting segment 2322 extending transversely from the spacer segment 2321 and parallel to the horizontal plane so as to define with the foot-supporting plate 23 an accommodation space 2323 for the user's foot.

A guiding rail 33 has a second proximate end secured to the seat member 10 between the elongated rods 27 and a second distal end. The sliding member 30 includes a flat plate 31 with two wheels 311,312 to slide along the rail 33, and a height-adjustable handle 32 extending upwardly from the plate 31 and retained thereon by an insert pin 321.

Each connecting rod 40 has two ends connected pivotally to the respective first distal end and the sliding member 30. In addition, a short assisting rod 25 has a third proximate end mounted to the seat member 10 between the first proximate ends, and a third distal end extending parallel to the rail 33. A sleeve 251 is mounted slidably on the assisting rod 25 between the third proximate and distal ends. Two engaging rods 26 connect pivotally the sleeve 251 and the first proximate ends respectively so as to facilitate the synchronous movement of the elongated rods 27.

Referring to FIG. 2, the user sits on the seat member 10, and his legs are supported by the leg-supporting plates 21 while his feet are placed on the foot-supporting plates 23. Subsequently, the user may grip the handle 32 and move the sliding member 30 toward the second distal end along the rail 33. The connecting rods 40 are moved along with the sliding member 30 to be in a stretching position so that the first distal ends of the elongated rods 27 swing in opposite directions to spread outwardly. As such, the user can bend his trunk forward and split his legs. Then, the sliding member 30 is returned back toward the second proximate end so that the connecting rods 40 are retracted to draw together the first distal ends of the elongated rods 20.

Figure 3:
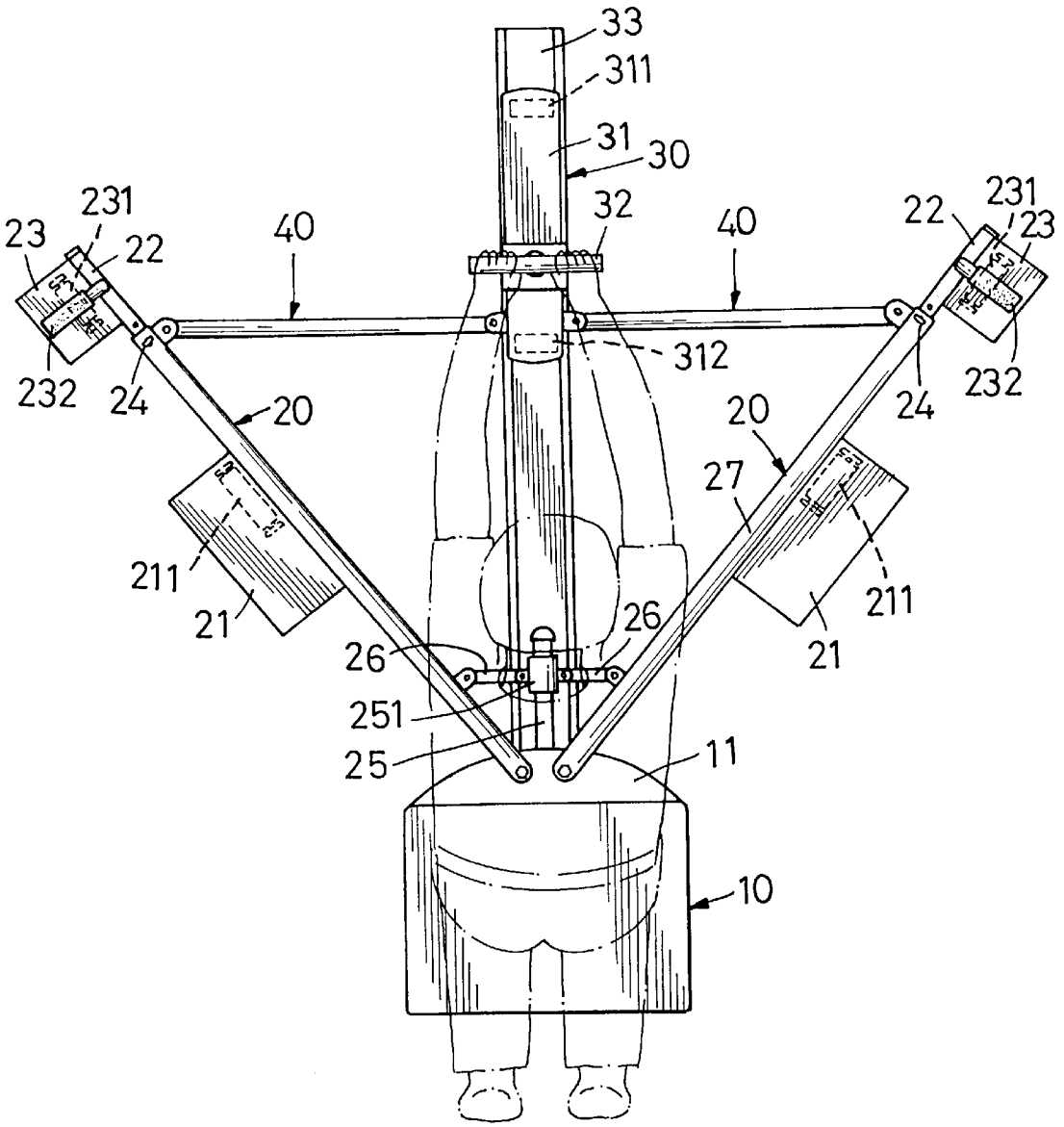
FIG. 3 is a schematic view showing another operating mode of the first preferred embodiment.

FIG. 3 shows another operating mode of the body exerciser. The user can kneel on the seat member 10 and grip the handle 32 to move the sliding member 30 between the second proximate end and the second distal end so as to exercise his arms and trunk.

Figure 4:
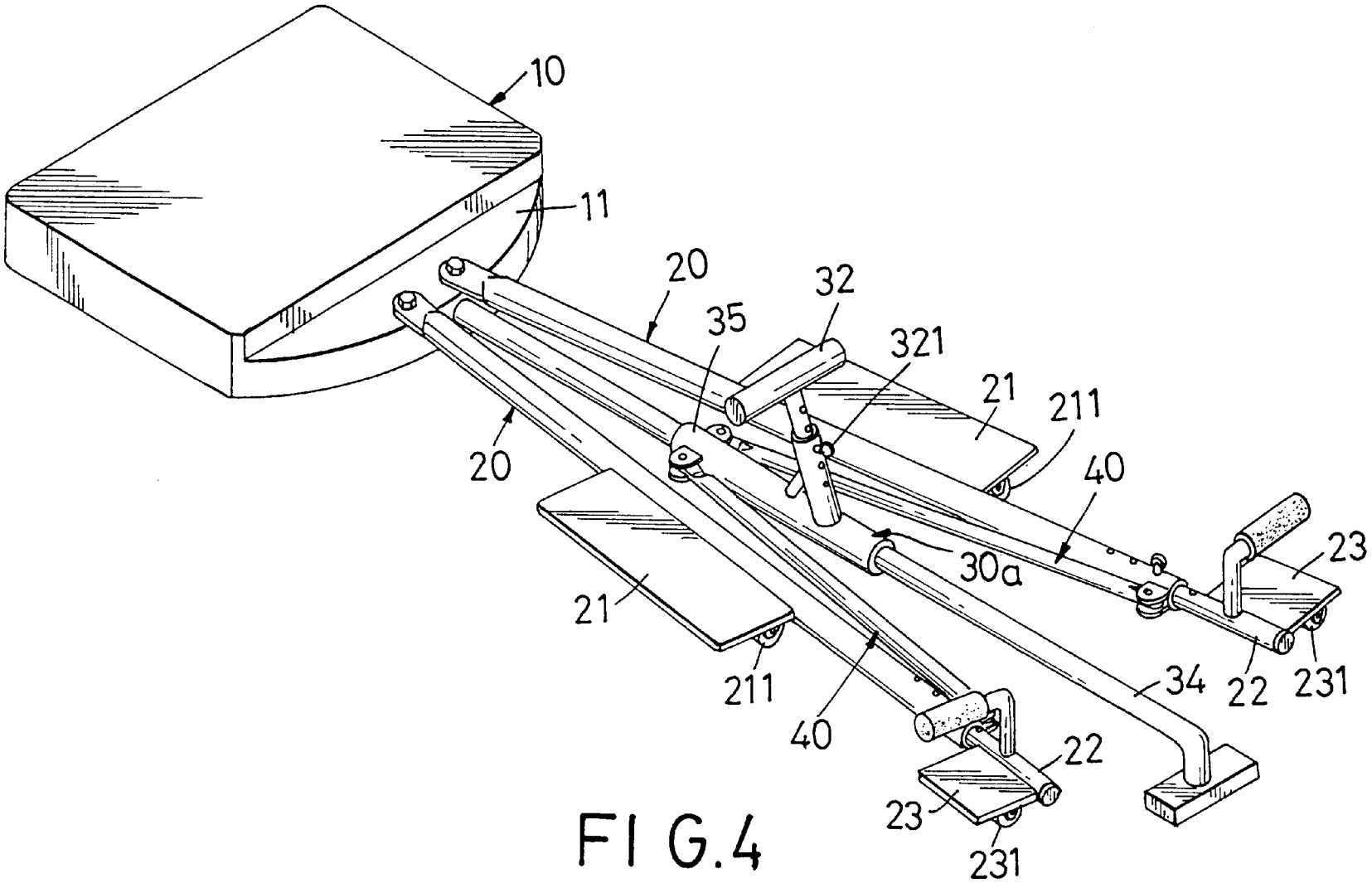
FIG. 4 is a perspective view of a second preferred embodiment of this invention.

Referring to FIG. 4, the second preferred embodiment of the body exerciser of this invention is similar to the first preferred embodiment in construction except for the lack of the assisting rod 25, the sleeve 251 and the engaging rods 26 of the previous embodiment. In addition, a guiding rod 34 is provided to replace the guiding rail 33. A sliding member 30*a* has a sliding sleeve 35 mounted on the guiding rod 34 to replace the flat plate 31.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A body exerciser comprising:

a seat member;

a pair of leg supporting members having first proximate ends mounted pivotally to said seat member, and first distal ends extending from said first proximate ends and swinging respectively relative to said seat member in opposite directions on a horizontal plane;

a guiding member having a second proximate end secured to said seat member between said first proximate ends and a second distal end extending from said second proximate end between said first distal ends;

a sliding member mounted slidably on said guiding member; and a pair of connecting members connecting pivotally said first distal ends of said leg supporting members and said sliding member, respectively, said connecting members moving between a stretching position when said sliding member is moved toward said second distal end so as to spread apart said leg supporting members, and a retracting position when said sliding member is moved toward said second proximate end so as to draw together said leg supporting members.

2. The body exerciser as claimed in claim 1, wherein said guiding member is a rail, said sliding member having at least one wheel which is slidable on said rail.

3. The body exerciser as claimed in claim 2, further comprising:

an assisting rod having a third proximate end secured to said seat member between said first proximate ends and a third distal end extending parallel to said rail;

a sleeve mounted slidably on said assisting rod between said third proximate end and said third distal end; and a pair of engaging rods connecting pivotally said sleeve and said first proximate ends, respectively.

4. The body exerciser as claimed in claim 1, wherein each of said leg supporting members includes an elongated rod having two ends acting respectively as said first proximate end and said first distal end, and a foot-supporting plate mounted to said elongated rod and extending laterally away from said guiding member.

5. The body exerciser as claimed in claim 4, wherein each of said leg supporting members further includes an insert rod extending telescopically from the respective one of said first distal ends, said foot-supporting plate being mounted on said insert rod.

6. The body exerciser as claimed in claim 4, wherein each of said leg supporting members further includes a wheel mounted under said foot-supporting plate and adapted to roll on the ground during the swinging of said leg supporting members.

7. The body exerciser as claimed in claim 4, wherein each of said leg supporting members further includes a foot-holding member having a spacer segment extending transversely from a respective one of said first distal ends and normal to said foot-supporting plate, and an instep abutting segment extending transversely from said spacer segment and parallel to said horizontal plane so as to define with said foot-supporting plate an accommodation space.

8. The body exerciser as claimed in claim 1, further comprising a handle mounted transversely on said sliding member.

9. The body exerciser as claimed in claim 1, wherein said guiding member is a guiding rod having two ends that act respectively as said second proximate end and said second distal end, said sliding member being a sliding sleeve mounted on said guiding rod.

* * * * *